United States Patent [19]

McNabb

[11] Patent Number: 4,753,050

[45] Date of Patent: Jun. 28, 1988

[54] APPARATUS FOR CLEANING AND PEENING INGOT MOLDS

[75] Inventor: Arthur J. McNabb, King and Frazier Rds. -D-12, Malvern, Pa. 19355

[73] Assignees: Penn Lehigh Crane Systems, Inc., Pottstown; Arthur J. McNabb, Malvern, both of Pa. ; a part interest

[21] Appl. No.: 869,405

[22] Filed: Jun. 2, 1986

[51] Int. Cl.[4] ..... B24C 3/32

[52] U.S. Cl. ..... 51/411; 29/815; 29/90.7

[58] Field of Search ..... 29/81 J, 81 R, 90 R, 29/90 A; 51/411, 427, 434; 408/199; 15/104.2; 241/275, DIG. 10

[56] References Cited

U.S. PATENT DOCUMENTS

| | | | |
|---|---|---|---|
| 2,532,136 | 11/1950 | Zahn | 51/433 |
| 2,670,991 | 3/1954 | Perkins | 51/433 |
| 2,900,765 | 8/1959 | Blackburn | 51/432 |
| 3,052,066 | 9/1962 | Foster | 51/433 |
| 3,353,796 | 11/1967 | Roberts | 29/90 R |
| 3,445,966 | 5/1969 | Moore | 51/432 |
| 3,521,406 | 7/1970 | Carpenter, Jr. | 51/432 |
| 3,675,373 | 7/1972 | Putnam | 51/432 |
| 3,824,738 | 7/1974 | Hall | 51/432 |
| 3,914,815 | 10/1975 | Kobayashi | 51/411 |
| 4,164,103 | 8/1979 | Hesse et al. | 51/432 |
| 4,291,509 | 9/1981 | Schulte et al. | 51/432 |
| 4,333,278 | 7/1982 | Schulte et al. | 51/434 |
| 4,480,413 | 11/1984 | Schulte et al. | 51/435 |

*Primary Examiner*—Howard N. Goldberg
*Assistant Examiner*—Irene Graves Golabi
*Attorney, Agent, or Firm*—Dann, Dorfman, Herrell and Skillman

[57] ABSTRACT

A blasting wheel apparatus for treating the interior surface of a hollow workpiece. There is a superstructure which can be moved into position in vertical registry with the open top of the workpiece. The superstructure has hoppers for storing shot pellets to be used in treating the interior surface and a shot feed tube extends downwardly from the hopper so that its open end may be passed through the open top of the cavity and into the interior of the workpiece. A stabilizer structure is movable along the axis of the shot feed tube to engage the top of the workpiece and position the open end of the shot tube within the central area of the cavity in the workpiece. Slides project upwardly from the stabilizer into the support structure. In one embodiment the shot tube has a lifting element at its lower end to engage under the stabilizer so that the stabilizer may be lifted with the superstructure. In another embodiment latches are provided on the slides to enable the stabilizer to be lifted with the superstructure. In the first embodiment the blasting wheel is mounted in the superstructure through a hollow drive shaft surrounding the shot tube. The hollow drive shaft for the wheel is encased within a tubular casing which passes through the center of the stabilizer structure. In the second embodiment the blasting wheel is mounted from below on an upright shaft so that it may be positioned under the shot tube through the bottom of the workpiece. In each case, the shot is fed to the wheel at a controlled rate under the control of a feed auger within the shot tube.

16 Claims, 7 Drawing Sheets

APPARATUS FOR CLEANING AND PEENING INGOT MOLDS

FIELD OF THE INVENTION

The present invention relates to apparatus for cleaning massive workpieces and has particularly application to apparatus for cleaning and peening the interior surfaces of ingot molds.

BACKGROUND OF THE INVENTION

In the steel making industry the ingot molds used for forming steel ingots must be descaled or cleaned between each use in order to remove the residual scale, splash and coating particles which remain after the steel is removed from the mold. A common procedure for cleaning ingot molds is to convey the molds to a mold-preparation area where a flail wheel is displaced into the mold cavity and is rotated therein so that the flails, normally chains or other flexible elements, are rotated within the cavity to impinge against the walls of the cavity and remove scale or residual particles which may be adhered thereto. Molds frequently have a fluted interior so that the impingement of the flails around the perimeter of the cavity effectively cleans the inwardly projecting parts of the flutes, but the valleys of the flutes and the corners often are not subjected to the flail action and are not effectively cleaned. In order to clean the valleys of the flutes and the corners, the interior surface may be abrasive blasted by a compressed-air blasting nozzle. Since the nozzle is normally manipulated manually by an operator, the effectiveness of the air blasting is variable, depending upon the skill and the diligence of the operator using the nozzle. Air blasting is also a very slow process requiring much more time than is available between normal mold reuse cycles. As a result of these deficiencies, the steel producers tolerate ingot molds which are incompletely cleaned, and poorly conditioned for reuse.

The present invention provides apparatus for efficiently cleaning and peening the interior of ingot molds. It may be installed in a steel-making facility in a cleaning area where the used molds may be received, cleaned and peened, and conveyed back to the steel-making area within the allowable mold recycling time.

SUMMARY OF THE INVENTION

The present invention provides an apparatus which includes a cleaning head which may be displaced into the center of the mold cavity and may be operated to efficiently and effectively treat the entire exposed surface within the cavity.

Specifically the present invention contemplates the use of a centrifugal blasting wheel in both directions about its central axis and means to feed large quantities of steel pellets to the wheel in a manner to obtain rapid, thorough and effective cleaning and/or treatment of the entire interior surface of the mold.

More specifically the present invention provides a centrifugal blasting wheel mounted on a vertical axis for displacement vertically into the center of the mold, coupled with a vertical feed tube for feeding measured large quantities of shot to the wheel in a fashion to assure proper cleansing of the exposed interior surface of the mold without loss of efficiency due to overfeeding or use of excess rotary power to drive the wheel.

Use of the apparatus of the present invention not only descales the interior surface of the mold, but also peens the surface by residually stressing the surface layer so as to retard the formation of cracks or other imperfections in the surface.

BRIEF DESCRIPTION OF THE DRAWINGS

The principal features of the invention are more fuly set forth hereinafter in connection with the accompanying drawings wherein.

DESCRIPTION OF THE PREFERRED EMBODIMENT

Figure 1:
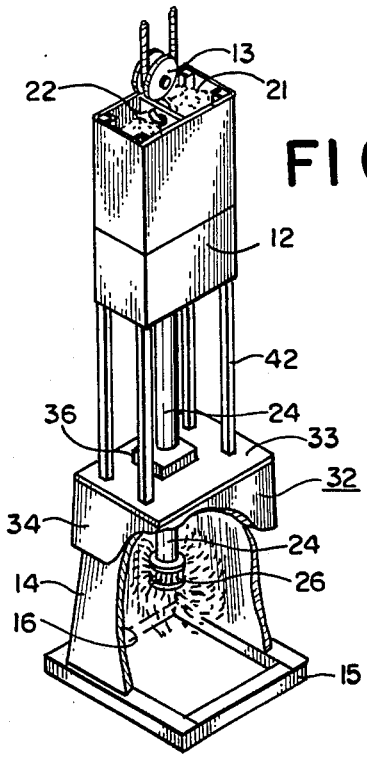
FIG. 1 is a pictorial perspective view of an apparatus embodying the present invention.
Figure 2:
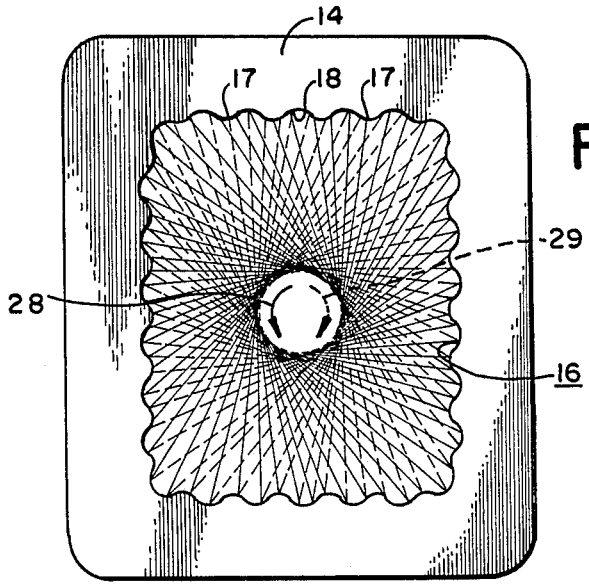
FIG. 2 is a top view of a mold showing a pattern of the trajectories of the shot within the mold as the blasting wheel rotates in opposite directions.

Referring now to FIG. 1, the cleaning head is a portable structure 12 adapted to be moved into position both horizontally and vertically by means of a hoisting apparatus such as a crane, the hook or grapple of which is shown at 13 in FIG. 1. The support structure 12 is adapted to be positioned over a mold 14 which is supported on a suitable stand 15 beneath which is locatd a standard abrasive recovery system (not shown). In the present instance, the mold 14 has upstanding walls which form an interior open-topped cavity 16 located in the central area of the mold. As shown in FIG. 2, the interior surface of the mold cavity 16 is fluted about the entire periphery to provide a series of inwardly projecting crests 17 separating intermediate valleys 18. The flutes extend from the top opening the full heigth of the sidewalls of the mold as indicated pictorially in FIG. 1.

As shown, the upper part of the support structure 12 provides hopper means 21, in the present instance having a single compartment partially separated by a partition 22 having a handle opening for receiving the hook or grapple 13 of the crane. Depending downwardly from the center of the structure 12 is a tubular hollow casing, which as shown in FIG. 1 penetrates into the interior of the mold cavity 16. At the lower end of the hollow casing 24 is a blasting wheel 26 which is adapted to be rotated in opposite directions to project shot pellets from the hopper 21 outwardly against the interior surface of the mold cavity 16 in a generally tangential direction to provide a trajectory of shot around the entire periphery of the wheel.

In FIG. 2, the trajectories of the shot pellets when the wheel is rotating counterclockwise (see arrow 28) are shown in solid lines, while the trajectories of the shot pellets when the wheel is rotating clockwise (see arrow 29) are shown in broken lines. As is apparent from inspection of FIG. 2, rotating the wheel 26 in opposite directions is effective to impinge the shot pellets against the interior surface not only against the inwardly projecting crests of the fluted walls but also into the valleys 18 between the crests 17. The opposite rotation subjects the entire surface of the fluted walls to the impingement of the shot pellets travelling in the trajectories indicated in FIG. 2. The impingement of the shot pellets against the fluted walls not only descales the walls from adhering particles and/or corrosion, but also serves to condition the surface, in accordance with the character of the shot pellets. Using normal shot pellets causes peening of the surface, i.e. surface-hardening, and residual compressive stress, which reduce the tendency to form cracks, or other imperfections in the interior mold surface. Shot peening not only work-hardens the surface, but also reduces porosity and reduces the effect of surface decarburization. As described more fully hereinafter the treatment of the surface with a cleaning head of the present invention provides for uniform and predictable surface treatment of the interior of the mold in an efficient and effective way.

Figure 4:
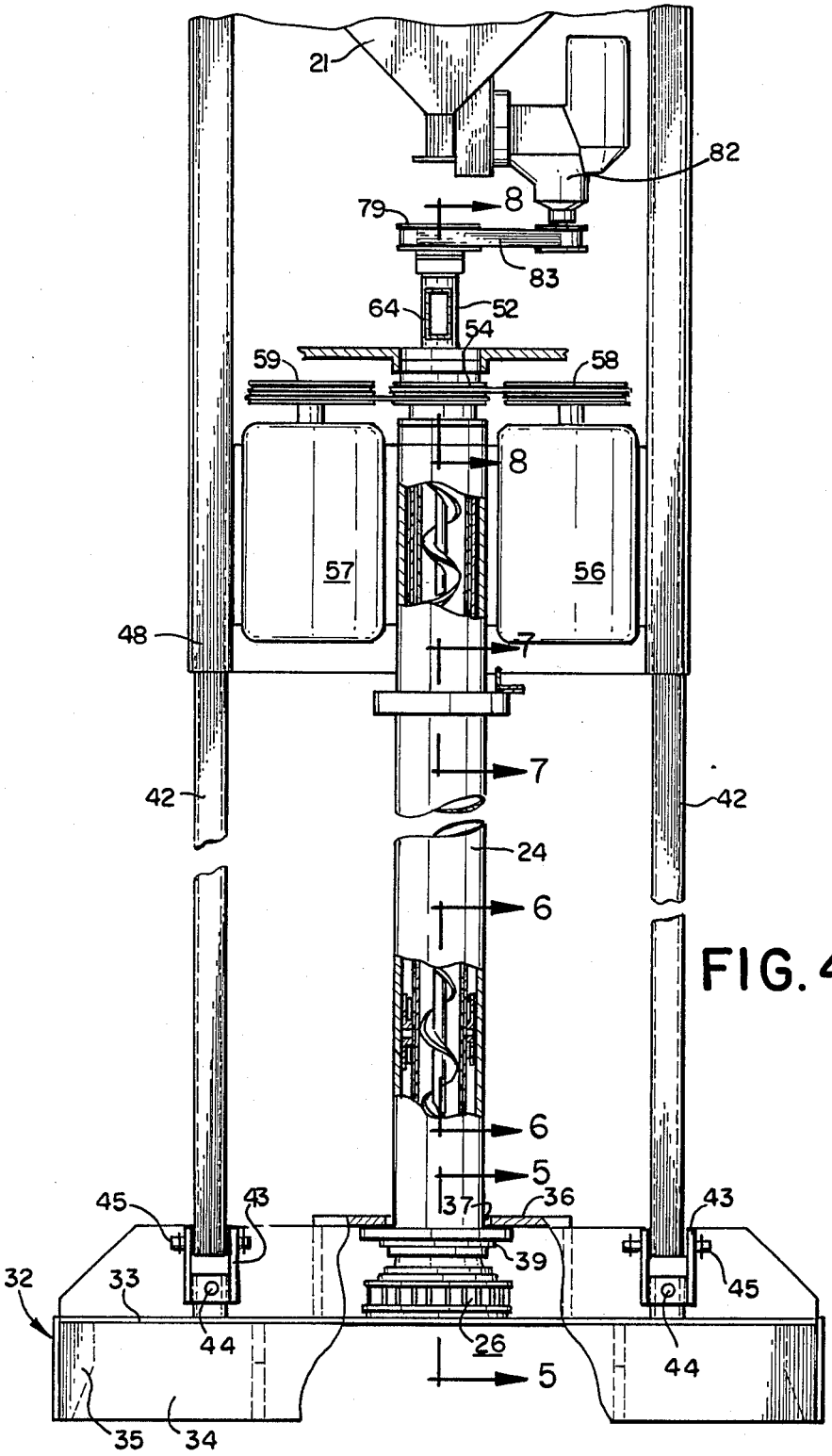
FIG. 4 is a sectional view taken on the line 4—4 of FIG. 3.

Mounted for vertical displacement on the tubular casing 24 is a stabilizing structure 32. In the present instance, the stabilizing structure 32 includes a substantially flat cover element 33 which is coextensive with the top of the mold 14 and has a depending guide skirt 34 about its periphery. As shown in FIG. 4, the skirt 34 includes inwardly facing guide elements 35 which depend downwardly and outwardly from the lower surface of the cover 33 so that when the stabilizing structure 32 is lowered onto the top of the mold 14, the guide skirt and guide elements 34 and 35 serve to position the structure centrally over the open top of the mold 14. Within the center of the cover 33 an upstanding housing 36 is provided which, as shown in FIG. 4, has a height and width sufficient to form a compartment which may enclose the wheel 26 when it is retracted against the underside of the housing 36. The casing 24 extends through a central bore 37 in the top of the housing. In the present instance the bore 37 is circular in outline and receives with limited clearance therearound the outer diameter of the tubular casing 24 so that the casing 24 may move vertically within the bore 37 without substantial impedence. The casing 24 terminates at its lower end in an outwardly projecting annular ring 38 whose outer diameter is greater than the diameter of the bore 37 so that when the tubular casing 24 is elevated through the bore 37 the annular ring 38 may engage under the top surface of the housing 36 and may then serve as a lifting structure to elevate the stabilizing structure 32 as the tube is further elevated. Thus the elevation of the tubular casing 24 serves to carry with it the stabilizing structure 32 when the grapple 13 of the crane displaces the structure 12 into and out of vertical registry with the mold 14 on the carrier 15.

The stabilizing structure 32 is prevented from uncontrolled tilting by a plurality, in the present instance four upstanding slides 42 which are connected to the cover 33 by a universal connector 43 consisting of a link having a horizontal pivotal connection to the cover at 44 and a second pivotal connection at right angles to the connection 44 and to the longitudinal axis of the slide 42 at 45. The connector 43 therefore permits limited angular displacement of the cover relative to the individual slides so that the angular position of the cover may accommodate to the top surface of the mold 14 as it is lowered into engagement therewith. When disengaged from the mold, the connectors 43 and the slides 42 tend to maintain the top cover 33 substantially horizontal. The slides penetrate into the support structure 12 and are slidable in the support structure through the medium of glides in the form of elongated sockets 48 at each corner of the rectangular structure 12. The socket glides 48 permit the slides 42 to telescopically engage in the structure 12 permitting the support structure 12 to move parallel to the upright axis of the casing 24 substantially independently of the stabilizing structure 32 when the lift element 38 is displaced out of engagement with the lower surface of the housing 36.

In the dismounting and mounting of the cleaning head with the mold 14, the head is dismounted by elevating the casing 24 until the lift structure 38 engages the underside of the housing 36. Further elevation of the head structure then elevates both the casing 24 and the stabilizing structure 32 out of engagement with the mold. The clean mold may then be carried away and be replaced with a dirty mold. When the fresh mold is in place under the cleaning head, the structure is lowered until the stabilizing structure engages the top of the mold and the guide elements 35 center the bore 37 in the central area of the open topped cavity of the mold. When self-centered, the cleaning head is further lowered to disengage the lifting structure from the underside of the housing 36 permitting the wheel to pass through the open top of the mold into the central part of the mold cavity. When positioned within the cavity, rotation of the wheel is activated and shot pellets are fed to the wheel to project the pellets against the interior surface of the cavity. This cleans the interior surface and the casing may be raised and lowered within the cavity to ensure thorough cleaning of the entire height of the interior surface. At the conclusion of the cleaning operation, the feed of the shot pellets is interrupted and the rotation of the wheel is likewise interrupted. After which the tubular casing 24 is elevated to engage the liftng structure 38 under the undersurface of the housing 36 so that further elevation of the structure permits the stabilizing structure to be disengaged from the top of the mold.

Figure 5:
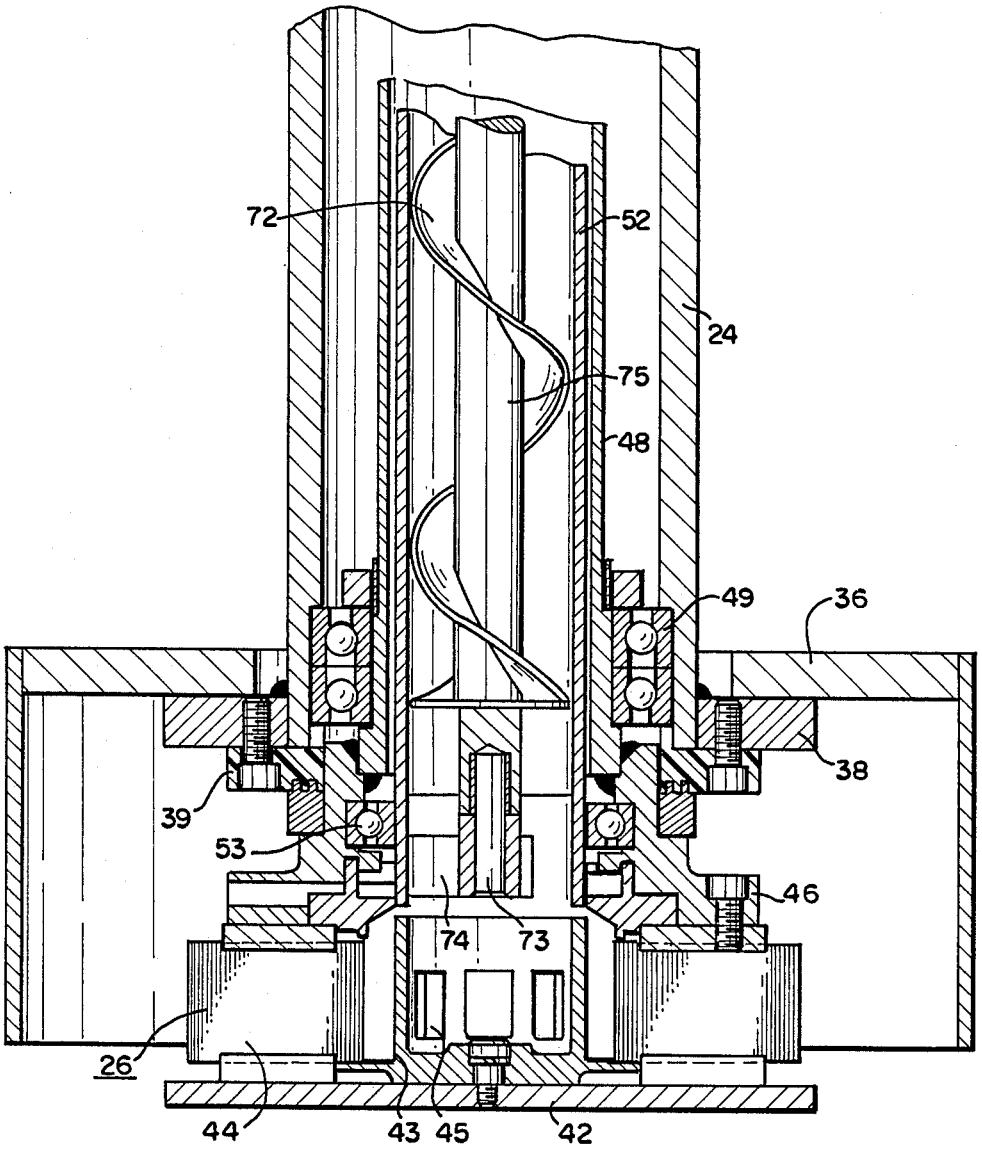
FIGS. 5, 6, 7 and 8 are enlarged local sectional views taken respectively on the lines 5—5, 6—6, 7—7 and 8—8 of FIG. 4.

The construction and arrangement of the blast wheel and the means for feeding the shot pellets to the wheel provides an efficient and effective control for assuring proper cleaning and peening of the mold cavities. To this end, as best shown in FIG. 5, the blasting wheel 26 includes a flat end plate 42 having an upstanding hollow hub 43 and radially extending blades 44 at spaced intervals about the hub. Ports are provided at 45 to permit the shot within the center of the hub to enter the space between the blades 44 so that when the wheel rotates the shot is flung outwardly in a trajectory determined by the rotary speed of the wheel. An annular cover 46 overlies the blades and the cover 46 serves to support the wheel on its drive shaft 48. In the present instance the drive shaft 48 extends upwardly from the cover 46 within the tubular casing 24 and is mounted for rotation within the bottom of the casing by bearings 49.

Shot pellets are fed into the hollow hub 43 by a feed tube 52 positioned within the hollow drive shaft 48. The feed tube 52 terminates in closely-spaced relation to the top of the hollow hub 43. The cover 46 of the wheel is mounted for rotation relative to the bottom of the tube 52 by suitable bearings 53 so that the shot travelling down the center of the tube is discharged from the open end of the tube 52 into the hollow hub 43 and through the apertures 45 between the blades 44 and into the trajectory, which in the present instance embraces the entire circumference of the wheel as shown in FIG. 2. To prevent the admission of shot pellets into the space between the drive shaft 48 and the tubular casing 24, a sealing washer 39 is mounted on the underside of the lifting ring 38 to engage the top structure 46 of the wheel 26.

Figure 8:
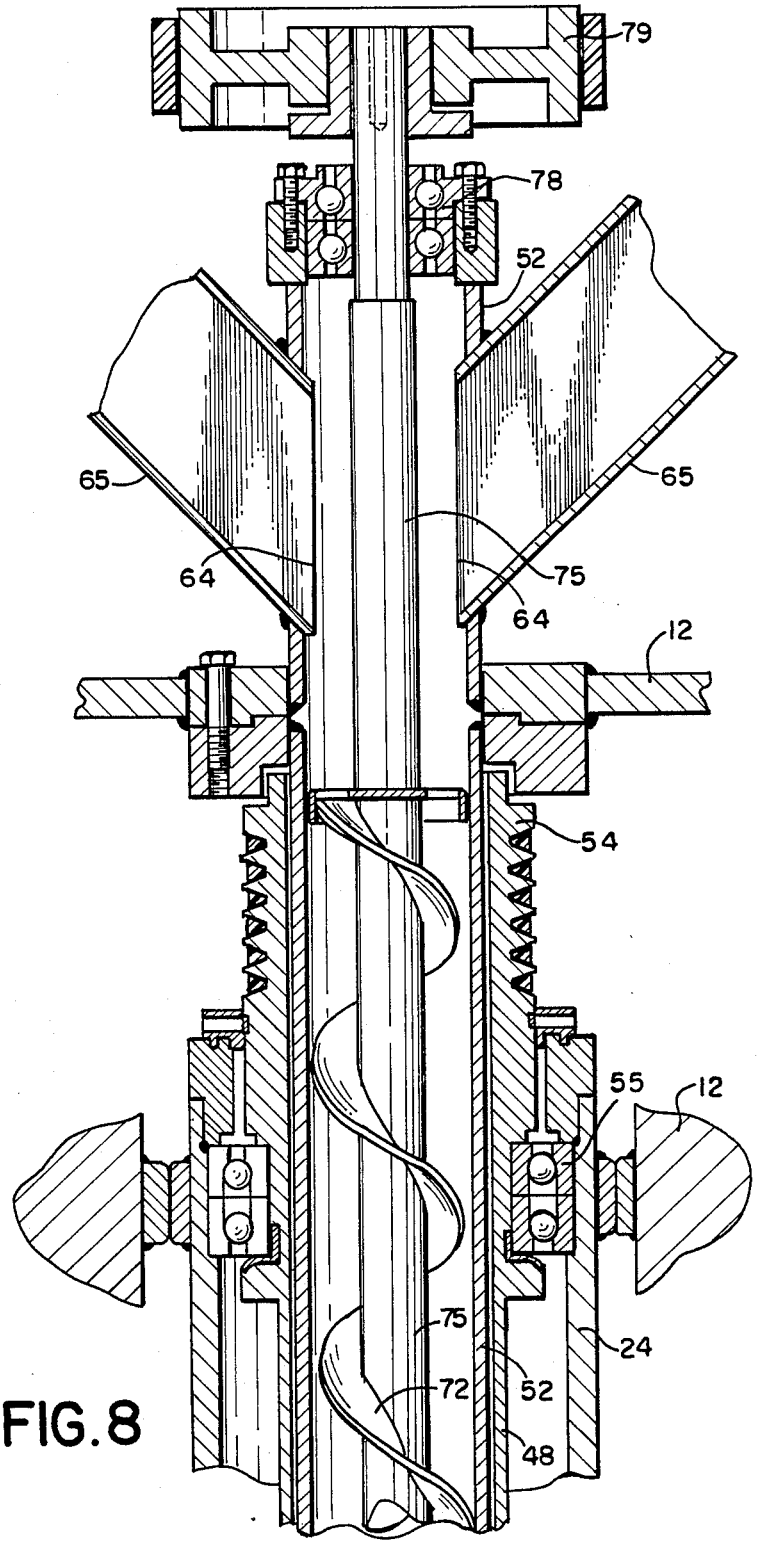

The hollow drive shaft extends upwardly through the tube 24 and, as shown in FIG. 8, terminates at its upper end in a drive pulley 54 which is rotatably mounted in the upper end of the tubular casing by a suitable bearing 55. The drive pulley 54, in the present instance is driven by two diametrically opposed drive motors 56 and 57 positioned on opposite sides of the tubular casing 24 within the superstructure 12. Interconnecting belts 58 and 59 provide the driving connections from the motors 56 and 57 to the pulley 54 in a balanced fashion. The motors 56 and 57 are reversible and are connected to a suitable energy source, such as a 220 volt line through a switching arrangement which permits the rotation of the motors to be reversed and controlled as to speed so as to control both the rotary speed and the direction of rotation of the wheel 26.

Figure 7:
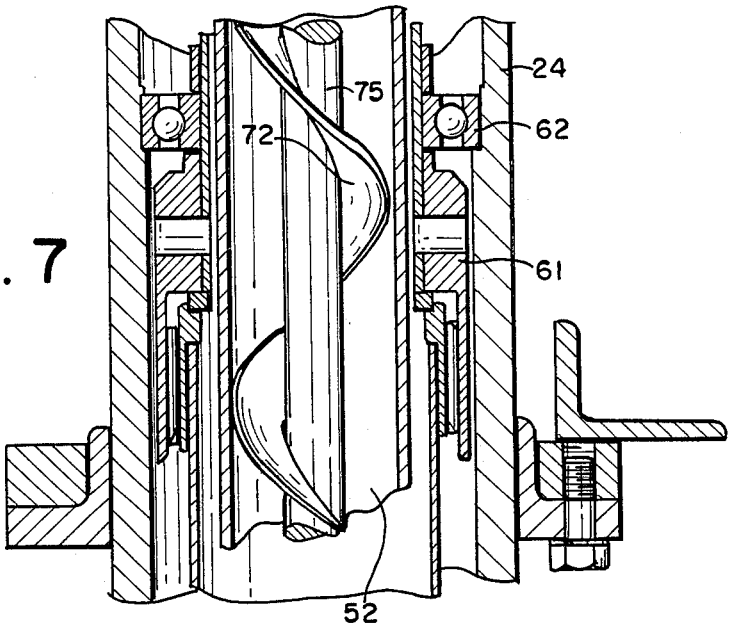
Figure 6:
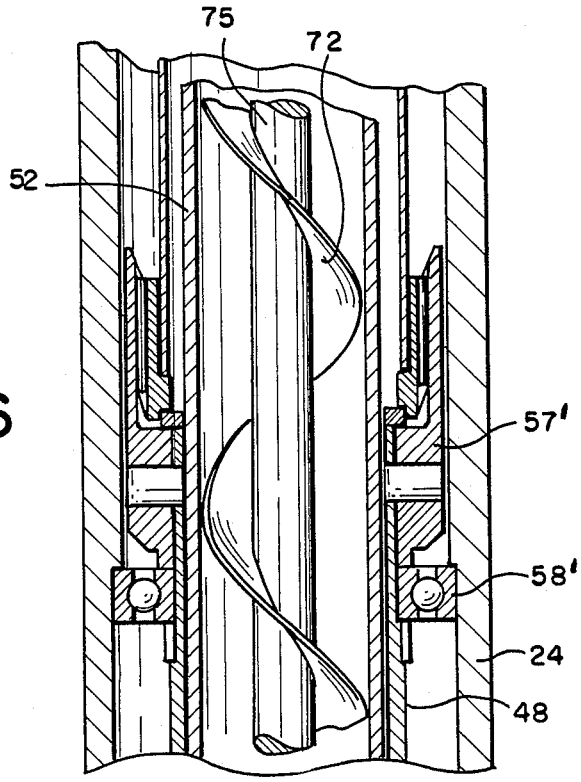

In the present instance the hollow drive shaft 48 is formed in three sections. The lower section of the shaft 48 mounts the blasting wheel at its lower end (see FIG. 5) and has a female spline 57' mounted in a bearing 58' within the casing 24 at its upper end (see FIG. 6). The lower end of the intermediate section of the shaft 48 has a male spline which mates with the female spline 57' and also has a male spline at its upper end (see FIG. 7) to mate with a female spline member 61 at the lower end of the upper section of the hollow drive shaft. The spline member 61 is mounted on the shaft and is centered within the tubular casing 24 by a bearing 62. In the present instance the pulley 54 is formed integrally with the upper end of the upper section of the drive shaft 48 as shown in FIG. 8. By reason of this construction and arrangement of the drive shaft for the wheel, it is a simple procedure to shorten or extend the drive shaft by simply replacing the central section of the shaft 48 with a section having a different length which produces the desired length of the drive shaft.

In order to provide a controlled feed of shot pellets to the rotating wheel 26, a feed tube 52 is mounted within the hollow interior of the hollow drive shaft 48. Shot pellets are introduced into the feed tube 52 at its upper end through ports 64 positioned diametrically opposite each other at the top of the feed tube 52. The ports have ducts 65 leading to metering valves 66 which control the flow of shot pellets from the two sides of the hopper 21 through the duct 65 into the shot feed tube 52. The valves 66 provide a controlled feed of shot pellets into the top of the shot feed tube 52. By controlling the flow of shot pellets into the tube and by controlling the rotary speed and direction of the wheel 26, the trajectory of the shot around the full circumference of the wheel may be controlled to achieve the desired descaling effect and the desired peening effect with maximum efficiency, i.e. minimum use of shot and minimum power expenditure for impinging the shot against the interior surfaces of the workpiece.

Figure 3:
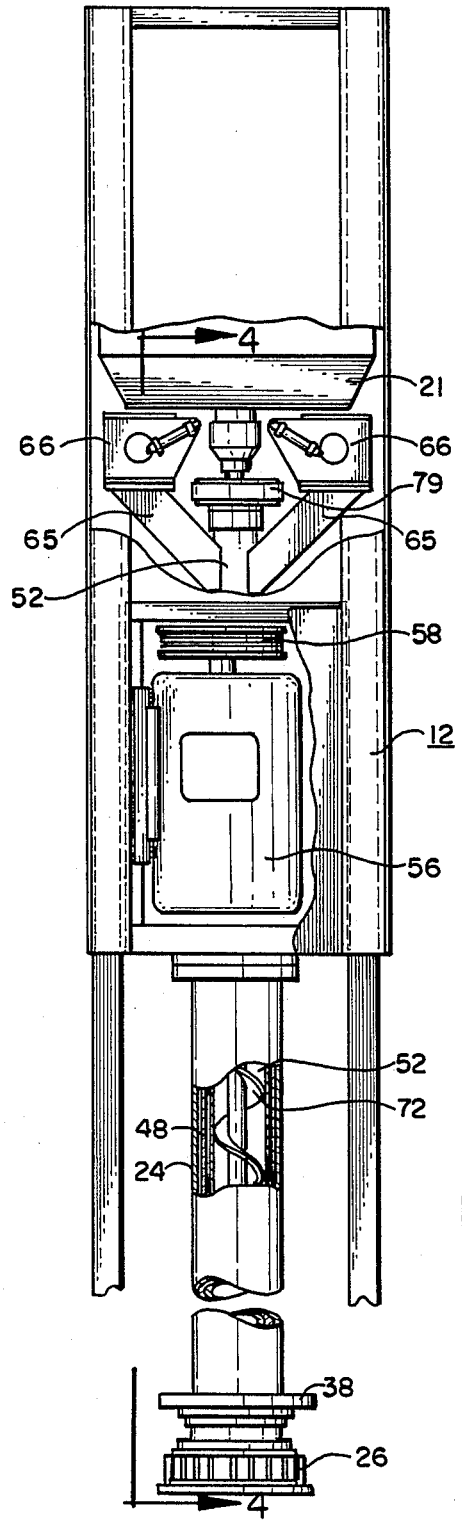
FIG. 3 is a left side elevation, partially in section, showing the apparatus with portions broken away to more clearly illustrate the construction thereof.

In order to achieve the proper control of the flow of shot pellets into and through the wheel 26, a feed auger 72 is mounted within the feed tube 52. The auger is mounted concentrically within the feed tube 52 for rotation on a stub shaft 73 (see FIG. 5) mounted in the bottom of the feed tube by a spider 74. The stub shaft includes a pin engaging the hollow end of the axle 75 of the auger 72. The auger 72, in the present instance, has a single continuous helical flight extending from adjacent the wheel 26 at the bottom of the feed tube 52 to a point adjacent the ports 64 at the top of the feed tube. Depending on the characteristics of the shot pellets employed in the apparatus, the character of the auger may be modified. At its upper end (see FIG. 8), the axle 75 of the auger extends upwardly beyond the end of the flight past the ports 64 through a bearing 78 in the feed tube 52 and terminates in a drive pulley 79. As shown in FIG. 4, the auger is rotated by a variable speed auger drive 82 which is connected to the drive pulley 79 through a drive belt 83 which may be of an appropriate form. It should be noted that the dual ducts 65 on opposite sides of the tube 52 provide an open space alongside the ducts below the hopper 21 which accommodates the pulley 79, the drive motor 82 and the belt 83 (see FIGS. 3 and 4). Rotation of the auger by the auger drive 82 serves to advance the shot pellets from the ports 64 to the open lower end of the shot feed tube at a controlled rate which assures a uniform feed of shot pellets into the hollow hub 43 of the wheel 26, preventing free fall of the pellets within the shot feed tube 52 while assuring a steady advance of shot pellets away from the ports 64, thus permitting the control valves 66 to operate effectively to provide a metered flow of shot pellets into the feed tube 52.

The apparatus, as described, provides a simple yet effective device for cleaning and peening the interior surface of hollow workpieces. The foregoing description has been made in connection with the cleaning of open-topped molds in which the mold cavity is open across its full width at the top. However, the same apparatus is equally effective to clean the interior surface of a workpiece having a restricted opening in its top wall which need only be sufficiently large to permit the passage of the wheel 26 and lifting ring 38 through the opening into the interior of the mold. The speed of rotation of the wheel may be selected to create a trajectory of the shot pellets whose outward dimension is many times the diameter of the central opening so that the apparatus is effective to treat workpieces having an internal cavity ranging from as small as two feet in diameter to ten or more feet in width. By controlling the feed of shot pellets into the wheel, the power requirement for rotating the wheel may be minimized to accommodate to the particular cavity configuration being treated by the apparatus.

Figure 9:
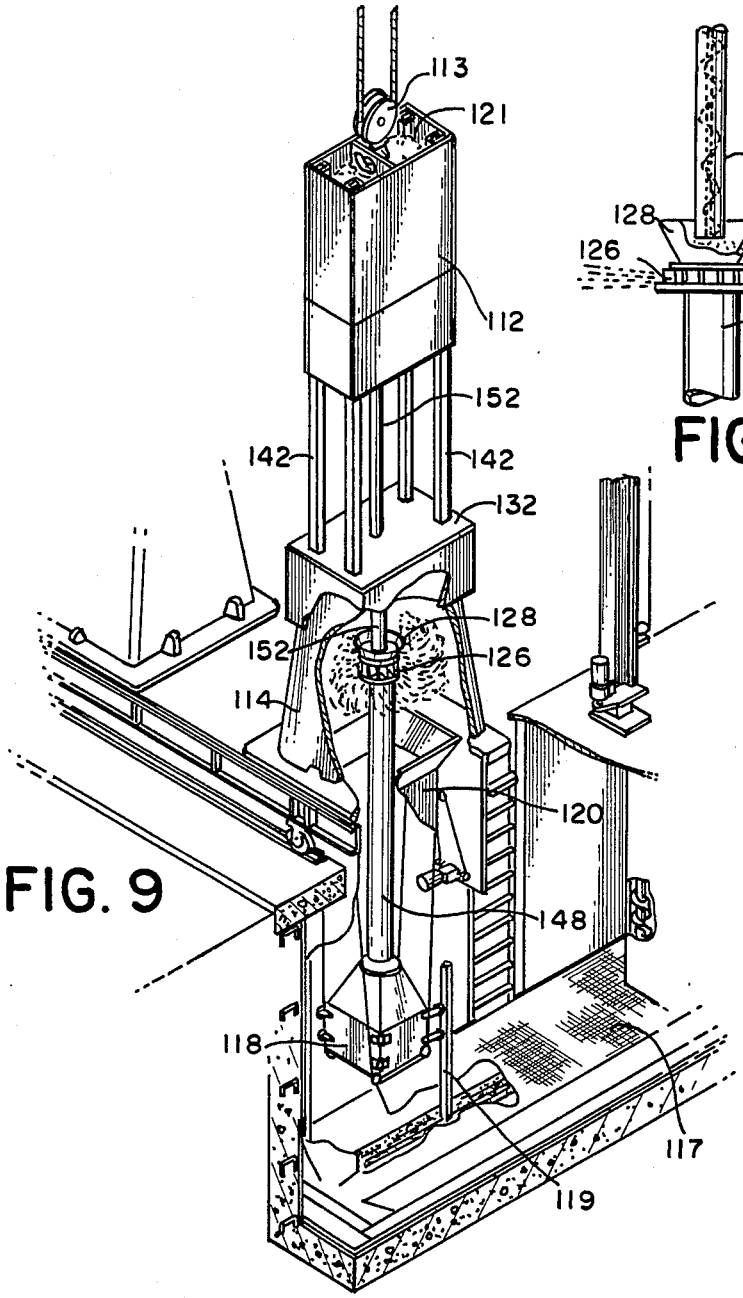
FIG. 9 is a view similar to FIG. 1 illustrating an alternate embodiment of the present invention.
Figure 10:
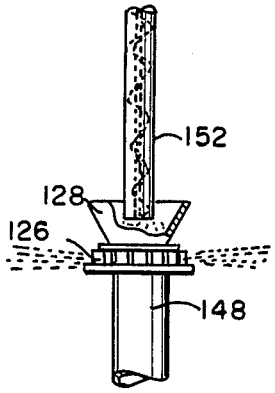
FIG. 10 is a fragmentary detail showing the blasting wheel of FIG. 9.

FIGS. 9 and 10 illustrate a modified embodiment of the apparatus which may be used where the top opening of the workpiece 114 is too small to receive a wheel of the proper diameter to achieve the desired treatment of the interior surface. As shown in FIG. 9, the testing apparatus includes a superstructure 112 having a hopper 121 for the shot pellets. The structure 112 is adapted to be supported by the hook or grapple of a crane as indicated at 113. The apparatus includes a stabilizer 132 which is mounted for vertical displacement relative to the structure 112 by means of upstanding slides 142. A shot feed tube 152 extends from the superstructure 112 through the stabilizer 132 into the interior of the cavity of the workpiece 114. In the present embodiment, the shot feed tube 152 is supported independently of the drive shaft for the wheel and thus is not encased within a tubular casing, as was the case in the previously described embodiment. The auger within the tube 152 is effective to enable controlled flow of the shot pellets from the hopper 121 through the stabilizer into the interior of the workpiece through the open lower end of the feed tube. In the present instance, the lower end of the shot feed tube is not provided with any lifting structure so that the reduced diameter of the external surface of the feed tube may be accommodated within a relatively small top opening in the workpiece. In the absence of a lifting structure on the lower end of the tube 152, the slides 142 are provided with latch devices (not shown) which mechanically couple the stabilizer 132 to the superstructure 112 so as to enable the stabilizer 132 to be raised with the superstructure 112 when the latches are engaged.

This embodiment of the invention is adapted to be used for a mold having an open bottom, the opening of which is larger than the diameter of the blasting wheel. As shown in FIGS. 9 and 10, the blasting wheel is mounted on a drive shaft 148 which projects upwardly from a substructure 118 mounted for vertical movement on glides 119. The wheel 126 is constructed similarly to the wheel 26 described above but the top cover of the wheel is provided with a funnel device 128 which is positioned under the open end of the tube 152 to receive the shot pellets discharged from the tube by its auger and to direct the pellets into the hollow hub of the wheel 126. The drive shaft 148 for the wheel projects upwardly from the substructure 118 through a discharge chute 120 which receives the spent shot after impingement against the interior surface of the mold and directs the spent shot back through recycling apparatus 117 where it is reconditioned for use in the hopper 121.

While preferred embodiments of the invention have been herein illustrated and described, it is not intended to limit the invention to such disclosure, but changes and modifications may be made therein and thereto within the scope of the following claims.

I claim:

1. Apparatus for cleaning the interior surface of an open-topped cavity in a workpiece, comprising a support structure, means to relatively position said support structure in vertical registry with the open top of said workpiece cavity, a hopper in the upper part of said support structure for receiving shot pellets, said hopper having discharge means including at least one opening, a shot-feed tube having an upright axis, said axis extending from said opening through the open top of said workpiece cavity, said tube having a hollow interior communicating with said opening at its upper end being open at its lower end, means supporting said tube for vertical displacement to afford said open lower end to be selectively positioned along said upright axis, above, below or within the open top of said workpiece cavity, a screw auger extending in said tube from adjacent opening to adjacent said lower open end, and means to rotate said auger at a rate to effect controlled feed of shot pellets from said opening through said open lower end, a stabilizer mounted at the lower end of said tube for displacement relative to said tube along said upright axis, said stabilizer having a central bore through which said tube depends, a cover extending outwardly from said bore beyond the perimeter of said open top, the outer edge of said cover having downwardly facing guide portions constructed and arranged to bear upon the workpiece and position the bore of the stabilizer within the central area of said open top, a blasting wheel having a vertical rotary axis and mounted in said structure so as to be positioned below the open lower end of said tube, said wheel having a hollow hub to receive shot pellets from the tube, and blades extending outwardly from said hub operable upon rotation of said wheel to disperse shot pellets from said hub outwardly in a trajectory about the full perimeter of the wheel, and means to rotate said wheel on its axis in opposite directions and at a rotary speed sufficient to cause the shot pellets in said trajectory to impinge against the interior surface of said cavity.

2. Apparatus according to claim 1 including a metering valve between said hopper and said opening to control the flow of shot pellets from said hopper into said tube.

3. Apparatus according to claim 1 wherein said tube comprises a hollow cylindrical wall surrounding said auger, and said opening is disposed in said wall of said tube adjacent its upper end, said screw auger having an axial drive shaft projecting upwardly along the axis of the tube and terminating in a drive pulley, said pulley comprising said means to rotate said auger.

4. Apparatus according to claim 3 wherein said means to rotate said auger includes a drive motor mounted in said support structure adjacent said hopper, and drive connections between said motor and said drive pulley.

5. Apparatus according to claim 4 wherein said hopper is disposed above said drive motor, and said opening comprises a pair of diametrically opposite ports in the wall of said tube below said drive motor, and a pair of ducts, each duct associated with one of said ports and extending from said hopper alongside said drive motor and terminating in the associated port.

6. Apparatus according to claim 1 wherein said stabilizer cover has a plurality of upwardly-projecting slide elements disposed substantially parallel to said upright axis, said support structure having glides receiving said slide elements to direct the movement of said stabilizer relative to said tube in a path generally parallel to said upright axis.

7. Apparatus according to claim 6 wherein said glides comprise tubular sockets having axes parallel to said upright axis and adapted to telescopically receive said slide elements, said slide elements having self-adjusting connectors between said slides and said stabilizer cover to afford limited angular accommodation of said stabilizer to angular positions of the workpiece relative to said upright axis.

8. Apparatus according to claim 7 wherein each of said connectors comprise a link pivoted to said slide on a first pivot axis transverse to the telescopic axis of the slide and pivoted to said cover on a second pivot axis transverse both to said telescopic axis and to said first pivot axis.

9. Apparatus acording to claim 8 wherein said tube has a lifting structure mounted at its lower end below said bore, said structure extending outwardly to engage the underside of said cover when said tube end is displaced upwardly above said open top along said upright axis to effect corresponding upward movement of said stabilizer away from open top.

10. Apparatus according to claim 1 wherein said shot-feed tube is rigidly mounted and supported in said support structure adjacent the upper end of the tube to dispose said upright axis substantially vertical, the lower part of the tube freely depending downwardly from said support structure, the lower end of said tube having a means providing vertical support for the auger within said tube.

11. Apparatus according to claim 10 wherein the vertical rotary axis of said blasting wheel is coaxial with said upright tube axis, said wheel being mounted on a vertical hollow drive shaft surrounding said shot-feed tube to position the hollow hub of the wheel immediately below the lower end of said shot-feed tube, said means to rotate said wheel including said hollow drive shaft and at least one drive motor mounted in said support structure upwardly along said shot-feed tube and coupled to said hollow drive shaft to effect rotation thereof, whereby said drive motor is effective to rotate said hollow drive shaft upon displacement of the open lower end of the tube below the open top of said workpiece cavity.

12. Apparatus according to claim 11 wherein said means to rotate said wheel includes a drive pulley adjacent the top of said hollow drive shaft, said at least one drive motor being positioned at one side of said drive pulley and including a second drive motor positioned diametrically opposite said one drive motor on the other side of said drive pulley, and drive belts connecting each of said drive motors to said drive pulley.

13. Apparatus according to claim 11 wherein said hollow drive shaft has at least three axial sections, and including splined joints interconnecting said sections, whereby the effective length of said hollow drive shaft may be changed by changing the length of the intermediate section by substituting a section of one length for a section of a different length.

14. Apparatus according to claim 11 enclosing said hollow drive shaft and including a fixed tubular casing extending substantially coextensively with said drive shaft and said shot-feed tube, said apparatus including bearings positioned between said casing and said hollow drive shaft to maintain said hollow drive shaft centered within said hollow casing, said hollow casing being rigidly mounted in said support structure adjacent the top of said shot-feed tube and suspended coaxial with said shot-feed tube and terminating adjacent the lower end thereof, the lower end of said casing having an outwardly projecting lifting structure adapted to support said stabilizer.

15. Apparatus according to claim 14 wherein said lifting structure comprises an annular ring projecting outwardly from said hollow casing at a position below the level of the bore in said stabilizer and having an outer diameter greater than the diameter of said bore so that when said casing is elevated, it engages the underside and raises the stabilizer.

16. Apparatus according to claim 15 wherein said cover includes a central housing forming a chamber adapted to enclose the lower end of said shot tube and the blasting wheel when said lifting structure engages the underside of said stabilizer to elevate the stabilizer, whereby said wheel is enclosed within said housing when said stabilizer is elevated away from said open top.

* * * * *

UNITED STATES PATENT AND TRADEMARK OFFICE

CERTIFICATE OF CORRECTION

PATENT NO. : 4,753,050

DATED : June 28, 1988

INVENTOR(S) : Arthur J. McNabb

It is certified that error appears in the above-identified patent and that said Letters Patent is hereby corrected as shown below:

Column 1, line 54, after "wheel" insert --in the cleaning head, the head including means to drive the wheel--;

Column 2, line 6, "fuly" should be --fully--;

Claim 9, line 1, "acording" should be --according--;

Signed and Sealed this

Eighth Day of November, 1988

*Attest:*

*Attesting Officer*

DONALD J. QUIGG

*Commissioner of Patents and Trademarks*